US007032530B1

(12) United States Patent
Ansay et al.

(10) Patent No.: US 7,032,530 B1
(45) Date of Patent: Apr. 25, 2006

(54) SUBMARINE AIR BAG LAUNCH ASSEMBLY

(75) Inventors: Michael T. Ansay, Johnston, RI (US); John R. Little, Swansea, MA (US)

(73) Assignee: The United States of America as represented by the Secretary of the Navy, Wahington, DC (US)

( * ) Notice: Subject to any disclaimer, the term of this patent is extended or adjusted under 35 U.S.C. 154(b) by 0 days.

(21) Appl. No.: 10/672,969

(22) Filed: Sep. 29, 2003

(51) Int. Cl.
*B63G 8/28* (2006.01)

(52) U.S. Cl. ..... 114/319; 114/312; 114/313; 114/316; 114/318; 89/1.809

(58) Field of Classification Search ..... 114/312, 114/313, 316, 318, 319; 89/1.809, 1.81, 89/1.811, 5
See application file for complete search history.

(56) References Cited

U.S. PATENT DOCUMENTS 3,137,203 A * 6/1964 Brown ..... 89/1.81
3,146,750 A * 9/1964 Ebbets et al. ..... 114/326
3,217,599 A * 11/1965 Meeker ..... 89/1.809
3,704,678 A * 12/1972 Kelly ..... 114/160
3,732,837 A * 5/1973 Hogan ..... 114/315
4,003,291 A * 1/1977 Vass et al. ..... 89/1.81
4,274,333 A * 6/1981 Lampton ..... 102/418
4,919,065 A * 4/1990 Murray et al. ..... 114/312
5,170,005 A * 12/1992 Mabry et al. ..... 89/1.81
5,419,272 A * 5/1995 Backstein et al. ..... 114/221 A
5,516,235 A * 5/1996 Stangroom ..... 405/188
5,964,175 A * 10/1999 Sirmalis et al. ..... 114/258
6,252,822 B1 * 6/2001 Obara ..... 367/1
6,484,618 B1 * 11/2002 Dubois ..... 89/1.11
6,530,305 B1 * 3/2003 MacLeod et al. ..... 89/1.81
6,701,819 B1 * 3/2004 Williams et al. ..... 89/1.81

FOREIGN PATENT DOCUMENTS

EP 0206932 * 12/1986

* cited by examiner

*Primary Examiner*—Michael Carone
(74) *Attorney, Agent, or Firm*—James M. Kasischke; Jean-Paul A. Nasser; Michael P. Stanley

(57) ABSTRACT

An air bag launch assembly is disclosed which allows for modular loading onto a submarine, the launch of weapons or vehicles external to the submarine pressure hull, while also achieving greater packing density. The air bag launch assembly includes a large, watertight pressure container; one or more smaller, watertight canisters used to contain the weapon or vehicle. The canisters are sized to fit within the larger pressure container. An air bag inflator is attached to the top and/or sides of the small canister to buoy the canister out of the container.

8 Claims, 3 Drawing Sheets

SUBMARINE AIR BAG LAUNCH ASSEMBLY

STATEMENT OF GOVERNMENT INTEREST

The invention described herein may be manufactured and used by and for the Government of the United States of America for Governmental purposes without the payment of any royalties thereon or thereto.

BACKGROUND OF THE INVENTION (1) Field of the Invention

The present invention relates to a launch assembly for expelling bodies from an underwater vehicle, and more particularly to an air bag launch assembly for launching weapons and/or vehicles from a submarine.

(2) Description of the Prior Art

Traditionally, weapons and other vehicles have been stowed inside a submarine's torpedo room where they are protected from the corrosiveness of the ocean. The weapons may thereafter be launched from the submarine torpedo tubes as needed. An alternate launch method used by submarines involves launching weapons from individual air tight pressure vessels that are located external to the submarine's pressure hull. These individual pressure vessels are stored within modular, external bays and protect the individual weapons from the high pressure and corrosiveness of the ocean environment.

The traditional method of storing weapons inside the submarine's pressure hull theoretically allows for very dense packing of weapons. However, if the space occupied by the torpedo tubes, impulse tanks, shutter doors, inlet cylinders, muzzle doors, breech doors, weapon launchers, and the weapon loading and handling system is added to the space occupied by the weapons, the apparent packing density of weapons is lost. By locating vehicles external to the submarine's pressure hull, the weight of the vehicles is greatly reduced. This is due to the buoyant force difference between air and water. This weight difference allows for a smaller less costly submarine volume to float the weight of the vehicles.

Individual weapons located in individual pressure vessels external to the submarine's pressure hull also occupy excessive space thus limiting the packing density, and adding significant weight to the submarine. Each individual pressure vessel has its own thick walled cylinder, self contained gas generator, launch capsule, muzzle door, weapon positive pressure ventilation system, and operational hydraulics and linkages. This adds to the complexity as well as the weight of the system.

Accordingly, there is needed in the art a launch system which is low in cost to construct and operate, high in reliability, easy to maintain, and safe to operate. Preferably, the launch system should also be simple in design, quiet during operation, relatively lightweight, and compact.

SUMMARY OF THE INVENTION

The present invention is directed to an air bag launch assembly which allows for modular loading onto a submarine, the launch of weapons external to the submarine pressure hull, while also achieving greater packing densities. The air bag launch assembly provides a simple method of launching weapons and/or vehicles from densely packed storage bins located within modular payload bays on submarines. According to one embodiment, the air bag launch assembly includes a large, watertight pressure container or payload bay, one or more smaller, watertight weapon canisters used to contain the weapon and/or vehicle and which is sized to fit within the larger pressure container; and one or more air bag inflators attached to the top and/or sides of the small weapon canisters. A support framework designed to hold multiple weapon canisters in position within the larger container may also be provided. Preferably, the containers are designed to withstand pressure to the deepest operating depths of the submarine to which they are attached, whereas the smaller, weapon canisters need only be capable of withstanding shallow sea pressures since they are housed within the larger containers.

BRIEF DESCRIPTION OF THE DRAWINGS

It should be understood that the drawings are provided for the purpose of illustration only and are not intended to define the limits of the invention. The foregoing and other objects and advantages of the embodiments described herein will become apparent with reference to the following detailed description when taken in conjunction with the accompanying drawings in which.

DESCRIPTION OF THE PREFERRED EMBODIMENTS

Figure 1:
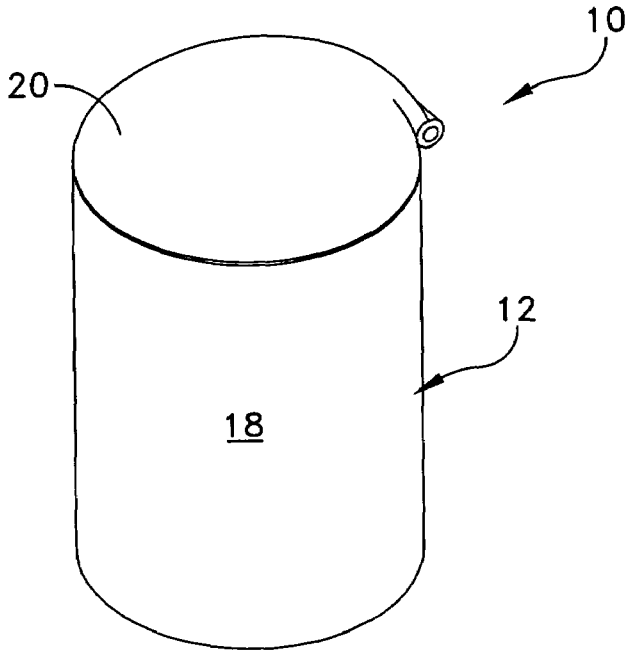
FIG. 1 is a perspective view of an air bag launch assembly according to the present invention in a closed, non-operative position.
Figure 2:
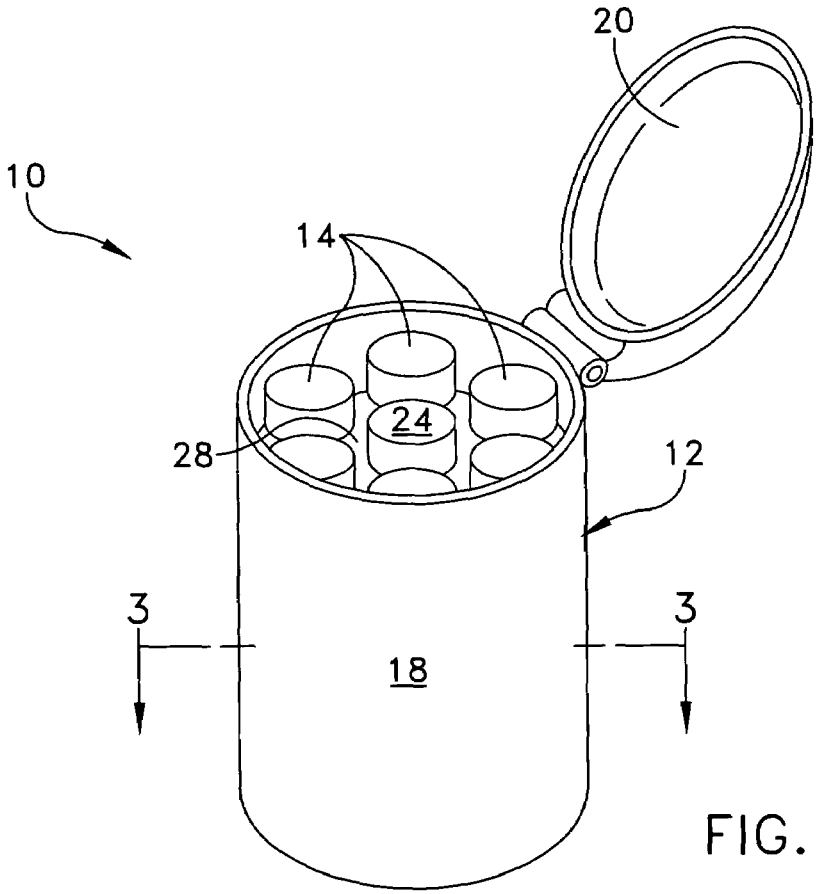
FIG. 2 is a perspective view of the air bag launch assembly of FIG. 1 in an open position.
Figure 4B:
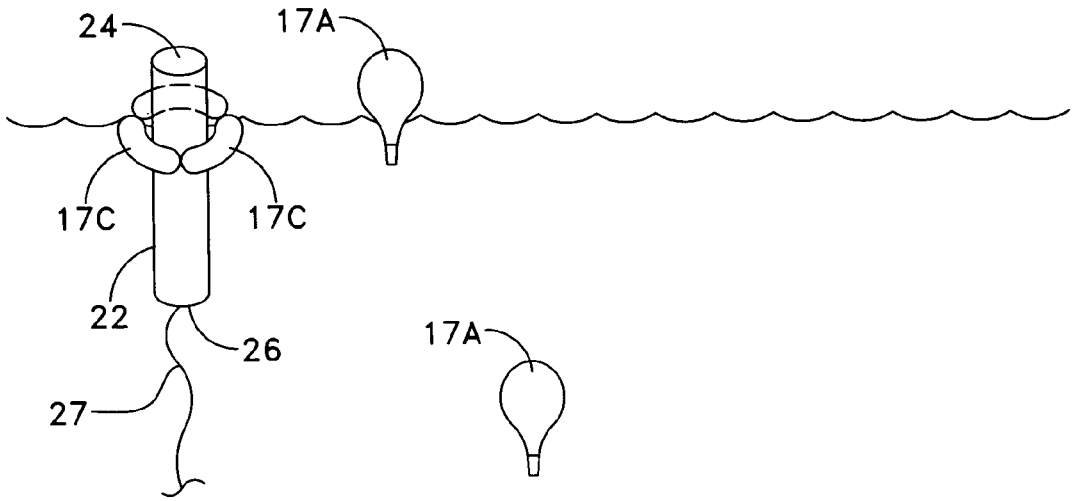
FIGS. 4A and 4B are diagrammatic representations of the air bag launch assembly of FIG. 1 during launch of a weapon or other device.
Figure 4A:
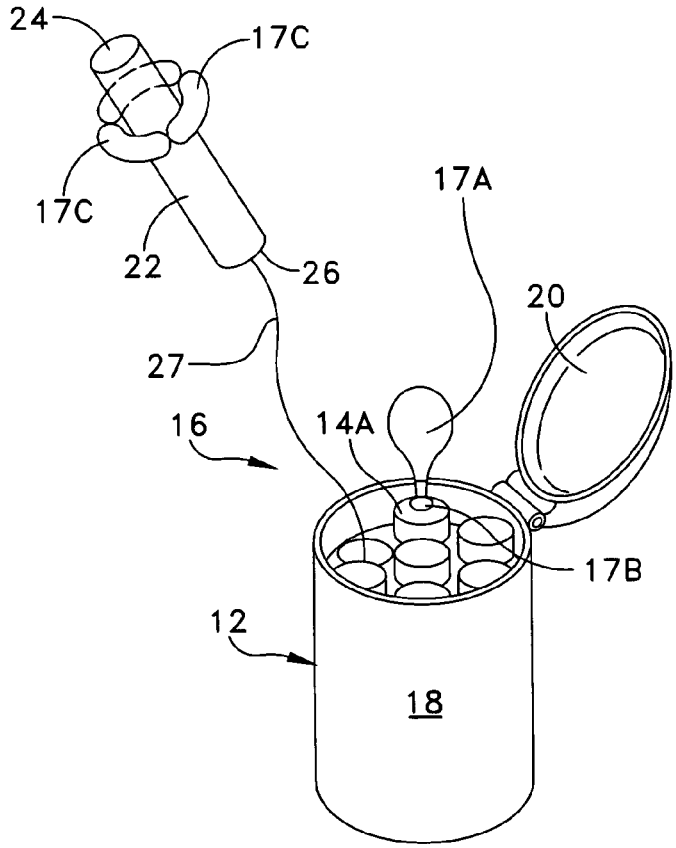

Referring now to the Figures, the air bag launch assembly 10 includes a payload bay or pressure container 12 designed to be mounted externally on a hull, one or more smaller canisters 14 for storing a weapon, vehicle, or other device (not shown) and which is sized to fit within the larger pressure container 12; and one or more air bag inflators 16 (FIG. 4) supported on a corresponding canister. The weapon, vehicle, or other device can be generally termed as a payload. The larger pressure container 12 is preferably watertight and should be made of a material that can withstand ocean pressure to the deepest operating depths of the submarine hull to which the pressure container is to be attached. The containers 12 may be removably attached to the hull of the submarine in any known manner and may preferably include a body 18 sized to hold the smaller canisters 14, and a cover or hatch 20 which is moveable between a closed (FIG. 1) and an open (FIG. 2) position for launching the canisters 14. The body 18 may preferably be cylindrical, as shown, or any alternate shape. In the closed position, the pressure container 12 will normally be filled with air until a canister launch is desired. Because the large pressure containers 12 are used to protect the devices stored within the smaller canisters 14 from the corrosive seawater, they should also be made of a corrosion resistant material. A watertight seal may also be provided so that the containers remain watertight when closed as the submarine maneuvers through the ocean environment.

The smaller canisters 14 can be provided to protect the weapon, vehicle or other device during a dry launch as it travels a short distance through the ocean water and up to the ocean's surface. The canisters 14 may include a cylindrical body 22 that houses the weapon, vehicle, or other device to be launched, as shown, or any alternate shape and a top enclosure 24. Once the ocean's surface is reached, the top enclosure 24 of the canister 14 is opened to allow the device to exit. The canister design is similar to past Harpoon weapon canisters used when Harpoon weapons were launched from horizontal torpedo tubes. If desired, canister 14 can have a bottom enclosure 26 which may also be opened to allow exhaust gases to escape during launch of the device from the canister 14. An optional tether 27 is shown for providing communication between body 18 or submarine and canister 14 after release. The watertight canisters 14 also prevent corrosion and/or electrical damage to the stored device, as the devices remain dormant until needed. In particular, when the large container 12 is flooded to equalize pressure with the ambient ocean surroundings, the small canister protects their stored weapons and/or vehicles. Thus, the individual canisters 14 get wet each time the large container 12 is flooded to launch a weapon and/or vehicle. The watertight canisters 14 are also provided to help reduce the weight of the weapon and/or vehicle, and assist in ascending the devices to the ocean's surface.

For a weapon and/or vehicle that can withstand the ocean's depth pressures and corrosiveness, the watertight canister 14 need not be provided. In such a case, the air bag inflators 16 can be attached directly to the weapon and/or vehicle without the use of a separate canister. Alternately, the individual watertight canisters 14 can be designed to withstand sea pressure to the full operational depths of the submarine. This would eliminate the need for the single large airtight pressure container 18. However, it would require that the smaller canisters 14 be designed for continuous seawater immersion. The individual weapon and/or vehicle canisters may also be tethered to the large pressure container, or to the submarine, so that the canisters can be retracted back into the submarine, if necessary.

Air bag inflators 16 are used to lift the canisters 14 from the pressure container 12 using the buoyancy of air in water. One or more inflators 16 are preferably attached to the body 22 and/or top enclosure 24 of the individual canisters 14. The air bag inflator 16 on the top enclosure 24 of the canister 14A is preferably used to lift the canister out of the pressure container during launch. First, the large container 12 is flooded, equalized in pressure, and the hatch 20 is opened.

Each air bag assembly 16 has an air bag 17A and an inflator 17B joined in communication with air bag 17A. Air bag 17A can be any fluid impermeable bag that is capable of being stowed in the available space. This bag can be made from Mylar, rubber, a polymer material or the like. In a first embodiment, the inflator 17B can be a gas generator that is electrically activated to generate an inflation gas on receipt of an electrical signal. Gas generators are well known in the art of automobile air bag inflators. As an alternative, the inflator 17B can be a compressed gas source having an electrically actuated valve that releases the compressed gas into air bag 17A on receipt of a control signal. In either embodiment, inflator 17B should provide sufficient gas to lift canister 14 at the operational depth while not providing excessive gas that could rupture air bag 17A. Lifting air bag assemblies 16 must have a mechanism for coping with launches at depth and changing air pressures as the canister ascends. Stabilizing air bag assemblies 17C can be activated near the surface and have less need to accommodate depth pressures.

Once the container 12 is opened the air bag or bags are deployed to raise the weapon and/or vehicle canister 14 out of the submarine and into the water environment for a wet launch, or up to the ocean's surface for a dry launch. The buoyant force on the gas filled air bag provides the lift force to raise the weapon canister out of the container. Given that the weapon canisters contain air, and due to the buoyant force of water, the weapon canisters are relatively light in water and only a small lift force is necessary to raise the weapon canister. Once the weapon canister is a sufficient distance from the submarine, the top air bag 17A and/or the inflator 17B may be jettisoned and side air bag inflators may be deployed.

The side air bag inflators 17C are preferably used during a dry launch to buoy the weapon canister the remaining distance up through the ocean water and to the ocean's surface. Once the ocean's surface is reached, the side air bags may be used to stabilize the canister as it floats, and may thereafter be used to stabilize the weapon during launch. After the weapon is launched, the air bag inflator and the weapon canister may remain on the ocean's surface until they can be recovered.

For a wet launch, the side air bags are not needed. During a wet launch, after the top air bag has removed the canister a safe distance from the submarine, the weapon or vehicle's own propulsion system preferably directs the weapon and/or vehicle toward its target. The top air bag can be jettisoned at that time.

Figure 3:
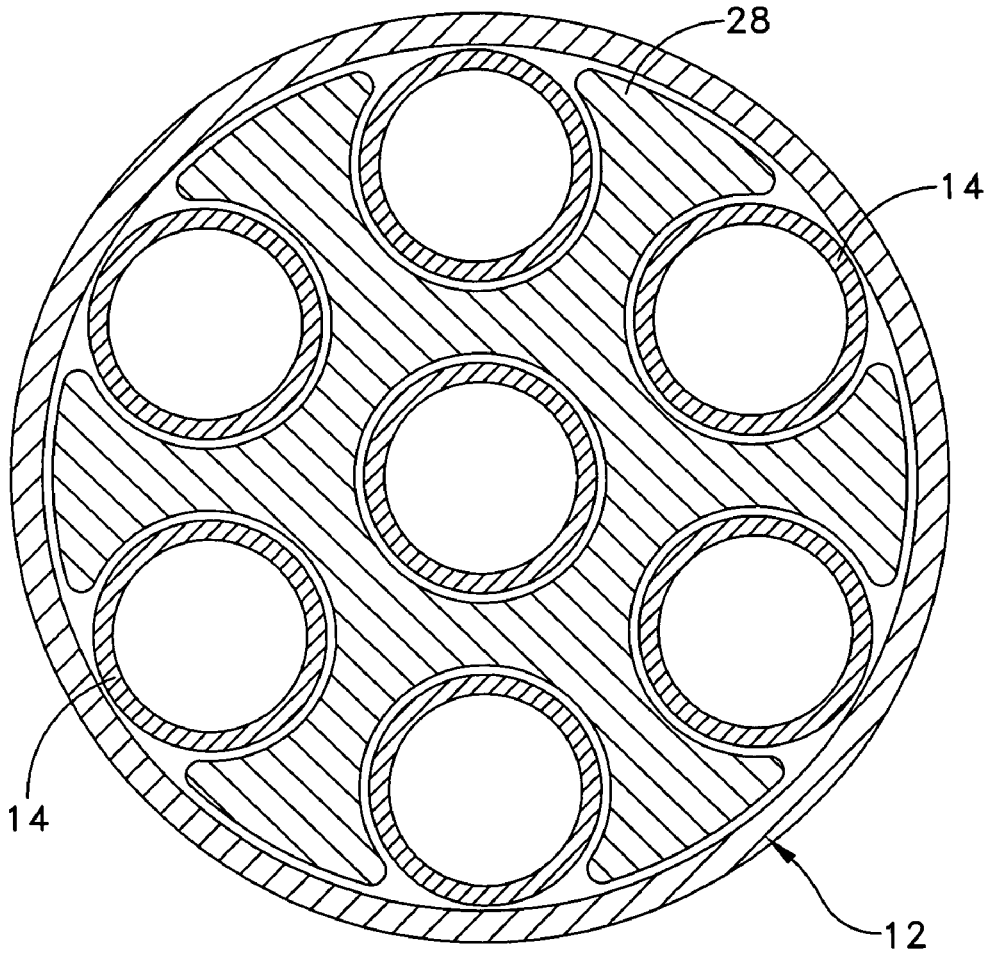
FIG. 3 is a cross-sectional view of the air bag launch assembly taken along lines 3—3 of FIG. 2.

A support framework 28 (FIGS. 2 and 3) may be provided to loosely hold the canisters 14 inside the larger containers 12. A loose, non-rigid connection may preferably be provided between the canisters 14 and the support framework 28 in order to allow for easy loading and launching. A rigid connection is not needed, as the canisters 14 will be held in place by the normally vertical orientation of the submarine and the weight of the canisters. However, a soft, shock absorbent material may be used to cover the support framework and interior portions of the container in order to cushion the canisters during aggressive submarine maneuvers and shock loads.

Operation of the air bag launch assembly 10 will now be described with reference to the Figures.

Once a weapon launch is called for, the submarine assumes a position sufficiently close to the ocean's surface. The large watertight containers 12 are then filled with water to equalize its pressure with the surrounding ambient ocean conditions. The water will occupy the air space around the small weapon canisters 14 inside the large container 12. When the pressure inside the large container 12 is balanced against the ambient ocean pressure, the top hatch 20 on the large container 12 is opened. Once the container 12 is opened, the air bag or bags are deployed to raise the weapon and/or vehicle canister 14 out of the submarine and into the water environment for a wet launch, or up to the ocean's surface for a dry launch. As described above, the top air bags 17A are preferably used to raise the canisters out of the containers. The side air bags 17C are preferably used during a dry launch to ascend the weapon canister the remaining distance up through the ocean water and to the ocean's surface. Once the ocean's surface is reached, the side air bags may be used to stabilize the canister as it floats, and may thereafter be used to stabilize the weapon during launch. As previously noted, for a wet launch, the side air bags are not needed and the top air bag may be jettisoned when the weapon and/or vehicle's own guidance and propulsion system takes over. Preferably, the air bags are launched from a vertical position within the canisters. However, the air bags may also be sized to launch from many small angles from vertical. In doing so the air bag buoyant force merely has to overcome the frictional force and the weapon and/or vehicles weight to lift the weapon and/or vehicle out of the support framework.

As will be appreciated, the combination of a large watertight pressure container, a small airtight weapon canister, a support framework, and an air bag inflator represent an improved method of launching weapons underwater. The advantages of the launch assembly include; easy loading/unloading of weapons, increased weapon packing density, cost and weight savings, and reliability advantages. The weapons can be loaded/unloaded individually or as an entire cartridge inside the support framework making them easy to load and unload. In either case, the weapon canister or weapons cartridge is simply lowered vertically into the large container or raised vertically out of it. Once loaded, the weapons are naturally secured in place due to their own weight, the designated space limitations, and the normally vertical orientation of the submarine.

Using the air bag launcher assembly also increases the packing density of the weapons. Given a higher packing density, either more weapons can be carried on a same size submarine or the same number of weapons can be carried on a smaller submarine. Current systems use individual pressure vessels for each weapon and large weapon launching systems such as gas generators, air turbine pumps, ram pumps, and elastomeric ejection systems. All these components occupy a significant amount of space. In contrast, one air bag inflator is small enough to fit into a person's hand.

The air bag launch assembly also eliminates the need for several complicated, expensive, and heavy components. If it is used to replace the existing torpedo tube weapon launching systems, several torpedo room components can be eliminated. Example components that may be eliminated include; impulse tanks, torpedo tubes, air turbine pumps, inlet cylinders, shutter doors, high efficiency inlets, and the weapon loading and handling systems. If it is used to replace the existing vertical launch system components such as the gas generator, the individual thick walled pressure vessel, the individual capsule, the individual muzzle door, and the individual hydraulic systems can be eliminated. In addition, the air bag launch assembly will be less costly to maintain since there are fewer components that require servicing.

Since the air bag assembly has fewer components that make up the entire launch system it is expected to have increased reliability and reduced maintenance. Because the air bag launcher itself has no moving parts, the wearing of parts over time is not a concern. Air bag inflators have demonstrated such reliability that they are used in millions of automobiles for personnel safety. The other components that make up the air bag vertical launch system are also well understood and known to be reliable.

It will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. An air bag launch assembly for launching a payload from an underwater vehicle comprising:

at least one canister constructed and arranged to hold a payload to be launched;

at least one air bag inflator supported on each canister and constructed and arranged to launch the canister;

a container having at least one canister supported therein wherein said container is substantially watertight and includes a body portion and a hatch, said container being removably attachable to a hull of the vehicle;

a tether attached between said at least one canister and said container; and a support framework constructed and arranged to support said at least one canister within said container.

2. The device of claim 1 wherein each canister comprises:

a body to contain the payload to be launched;

a top enclosure joined to the top of said body; and a bottom enclosure joined to the bottom of said body.

3. The device of claim 2 wherein said at least one air bag inflator comprises a top air bag inflator supported on the top enclosure of said at least one canister and constructed and arranged to lift said at least one canister during launch.

4. The device of claim 2 wherein said at least one air bag inflator comprises a side air bag inflator supported on the body of said at least one canister and constructed and arranged to stabilize said canister.

5. The device of claim 1 further comprising a payload to be launched positioned in said canister.

6. The device of claim 1 wherein said air bag inflator comprises:

an air bag joined to said at least one canister; and an inflation means in communication with said air bag for inflating said air bag.

7. The device of claim 6 wherein said inflation means is a gas generator.

8. The device of claim 6 wherein said inflation means is a compressed gas source.

* * * * *